US008079801B2

(12) United States Patent
Yoshida et al.

(10) Patent No.: US 8,079,801 B2
(45) Date of Patent: Dec. 20, 2011

(54) FAN UNIT

(75) Inventors: Yusuke Yoshida, Kyoto (JP); Naoki Nakada, Kyoto (JP); Mitsunobu Nakase, Kyoto (JP); Yasuyuki Kaji, Kyoto (JP)

(73) Assignee: Nidec Corporation, Kyoto (JP)

( * ) Notice: Subject to any disclaimer, the term of this patent is extended or adjusted under 35 U.S.C. 154(b) by 1091 days.

(21) Appl. No.: 11/923,026

(22) Filed: Oct. 24, 2007

(65) Prior Publication Data

US 2008/0101920 A1 May 1, 2008

(30) Foreign Application Priority Data

Oct. 27, 2006 (JP) ..... 2006-291970

(51) Int. Cl.
*F04D 25/16* (2006.01)

(52) U.S. Cl. ..... 415/66; 415/199.5; 416/120

(58) Field of Classification Search ..... 415/66, 415/68, 199.5, 199.6, 209.1; 416/120, 128
See application file for complete search history.

(56) References Cited

U.S. PATENT DOCUMENTS

| | | | | |
|---|---|---|---|---|
| 6,827,549 | B1 | 12/2004 | Horng et al. | |
| 7,052,236 | B2 * | 5/2006 | Chang et al. | 415/191 |
| 7,156,611 | B2 * | 1/2007 | Oosawa et al. | 415/68 |
| 2008/0008576 | A1 * | 1/2008 | Hong et al. | 415/68 |

* cited by examiner

*Primary Examiner* — Edward Look
*Assistant Examiner* — Dwayne J White
(74) *Attorney, Agent, or Firm* — Keating & Bennett, LLP

(57) ABSTRACT

A serial axial fan unit includes first and second motors with their base portions, i.e., first and second base portions axially facing each other. A motor gap is arranged axially between the first and second base portions. An axial length of the motor gap is preferably in a range from approximately 0.3 mm to approximately 2.0 mm. This configuration reduces transmissions of vibration of each of the first and second motors to the other, thereby reducing vibration interference between the first and second motors.

26 Claims, 12 Drawing Sheets

FAN UNIT

BACKGROUND OF THE INVENTION

1. Field of the Invention

The present invention relates to a fan unit including a plurality of axial fans connected in series.

2. Description of the Related Art

Cooling fans are used for cooling electronic parts inside a casing of various electronic devices. The cooling fans are required to have improved air flow characteristics, i.e., an improved static pressure vs. flow rate curve with the increase in the amount of heat generation associated with performance improvement of the electronic parts and the increase in the density of the electronic parts associated with size reduction of the casing. As an exemplary cooling fan which can provide a sufficient static pressure and a sufficient flow rate, a serial axial fan unit is currently used which includes a plurality of axial fans connected in series.

The serial axial fan unit, which is typified by a counter-rotating type, can provide a high static pressure and flow rate. However, operation sounds of the axial fans may interfere with each other, causing a large or harsh noise.

SUMMARY OF THE INVENTION

According to preferred embodiments of the present invention, a serial axial fan unit includes a first axial fan and a second axial fan connected to and arranged coaxially with a center axis of the serial axial fan unit. Each of the first and the second axial fans includes: a motor having a base portion arranged adjacent to the other axial fan; an impeller having a plurality of blades which are radially arranged about the center axis and extend outward in a radial direction substantially perpendicular to the center axis, the impeller being rotatable about the center axis to create an axial air flow; a housing surrounding the impeller; and a plurality of supporting ribs extending from the base portion of the motor outward in the radial direction and connecting the base portion to the housing. The first and the second axial fans are arranged with their base portions adjacent to and facing each other with a motor gap therebetween in an axial direction substantially parallel to the center axis. The housings of the first and the second axial fans are in contact with each other over their peripheries.

According to other preferred embodiments, a serial axial fan unit includes a first axial fan and a second axial fan connected to and arranged coaxially with a center axis of the serial axial fan unit. Each of the first and the second axial fans includes: a motor having a base portion arranged adjacent to the other axial fan; an impeller having a plurality of blades which are radially arranged about the center axis and extend outward in a radial direction substantially perpendicular to the center axis, the impeller being rotatable about the center axis to create an axial air flow; a housing surrounding the impeller; and a plurality of supporting ribs extending from the base portion of the motor outward in the radial direction and connecting the base portion to the housing. The first and the second axial fans are arranged with their base portions adjacent to and facing each other with a motor gap therebetween in an axial direction substantially parallel to the center axis. The housings of the first and the second axial fans are in contact with each other except for a region where a housing gap is arranged axially between the housings of the first axial fan and the second axial fan. The inside and the outside of the housings are in communication with each other through the housing gap. An axial length of the housing gap preferably is approximately 0.5 mm or less.

Other features, elements, advantages and characteristics of the present invention will become more apparent from the following detailed description of preferred embodiments thereof with reference to the attached drawings.

DETAILED DESCRIPTION OF PREFERRED EMBODIMENTS

Figure 1:
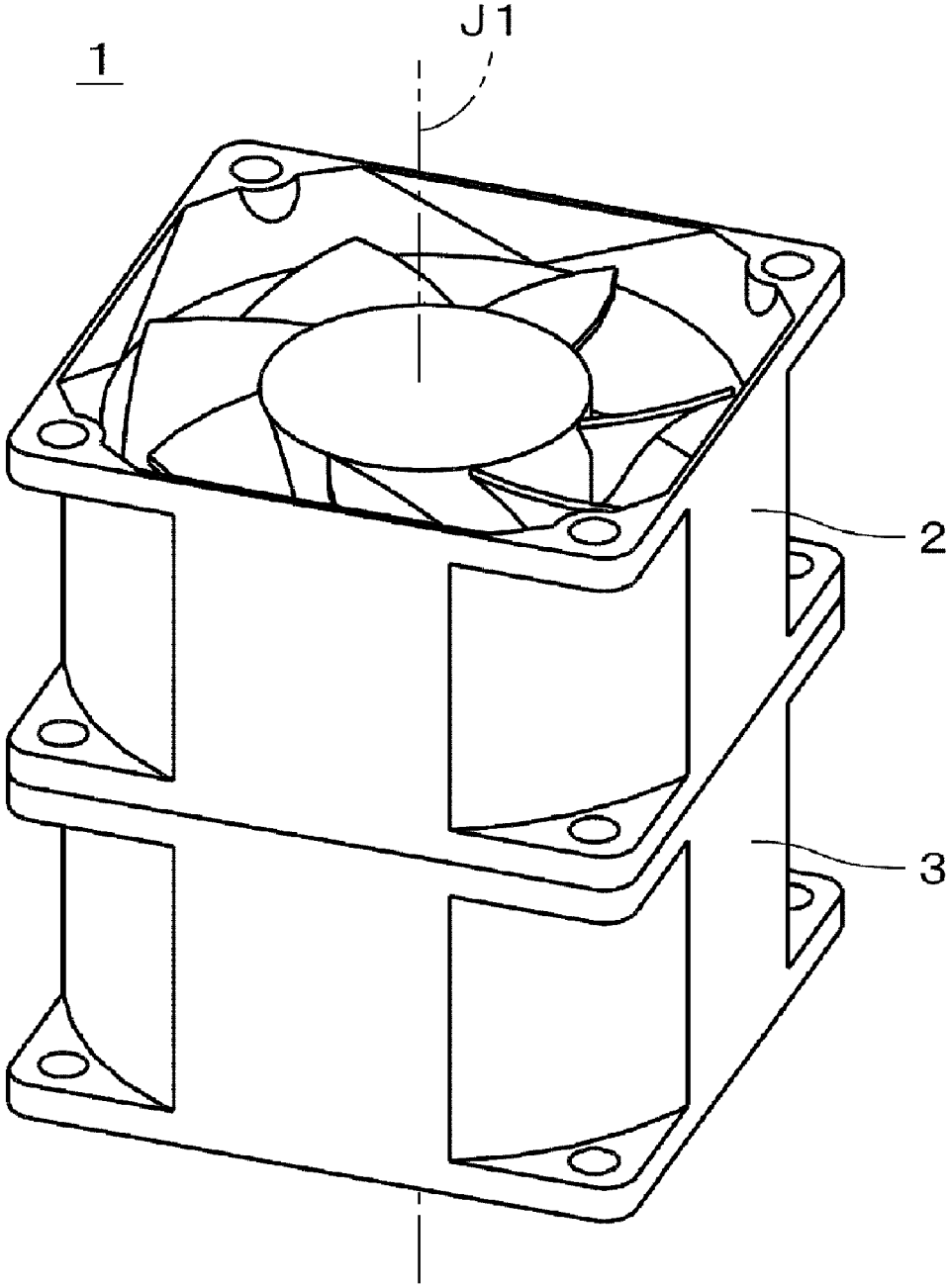
FIG. 1 is a perspective view of a serial axial fan unit according to a first preferred embodiment of the present invention.

Referring to FIGS. 1 through 11, preferred embodiments of the present invention will be described in detail. It should be noted that in the explanation of the present invention, when positional relationships among and orientations of the different components are described as being up/down or left/right, ultimately positional relationships and orientations that are in the drawings are indicated; positional relationships among and orientations of the components once having been assembled into an actual device are not indicated. Meanwhile, in the following description, an axial direction indicates a direction parallel to a rotation axis, and a radial direction indicates a direction perpendicular to the rotation axis.

First Preferred Embodiment

FIG. 1 is a perspective view of a serial axial fan unit 1 according to a first preferred embodiment of the present invention. The serial axial fan unit 1 is used for air-cooling the inside of electronic devices such as servers, for example. The serial axial fan unit 1 includes a first axial fan 2 and a second axial fan 3 which are coaxially arranged with a center axis J1 of the serial axial fan unit 1. The center axis J1 is also center axes of both the first and second axial fans 2 and 3. In the example of FIG. 1, the first serial fan 2 is arranged above the second axial fan 3. The first and second axial fans 2 and 3 are secured to each other by, for example, screwing.

Figure 2:
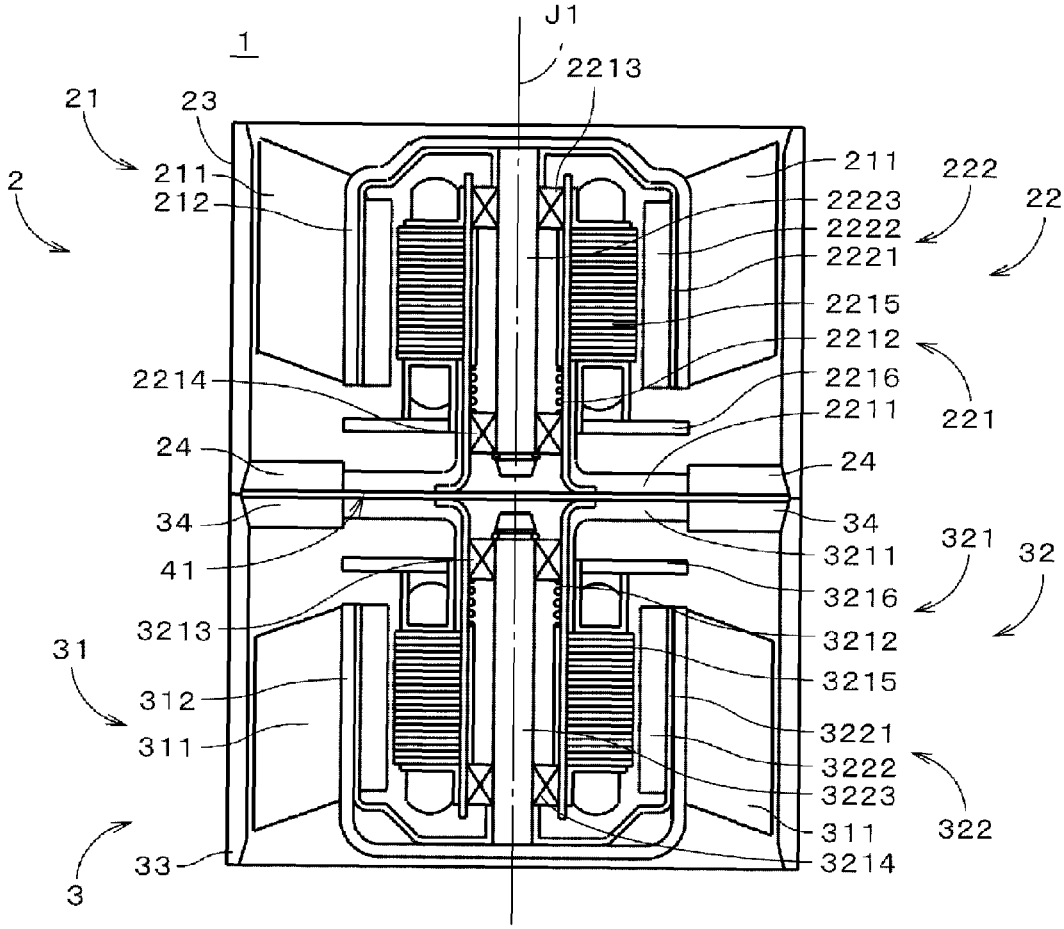
FIG. 2 is a vertical cross-sectional view of the serial axial fan unit of FIG. 1.

FIG. 2 is a vertical cross-sectional view of the serial axial fan unit 1 taken along a plane containing the center axis J1. The serial axial fan unit 1 of this preferred embodiment is a counter-rotating type. That is, a first impeller 21 of the first axial fan 2 and a second impeller 31 of the second axial fan 3 rotate in opposite directions relative to each other, thereby causing air to be taken into the serial axial fan unit 1 from the upper side in FIG. 1 (i.e., from above the first axial fan 2) and discharging the air toward the lower side in FIG. 1 (i.e., toward under the second axial fan 3). In this manner, the serial axial fan unit 1 creates an axial air flow, and can have a sufficiently high flow rate while improving a static pressure. In the following description, the upper side in FIG. 1 from which air is taken into the serial axial fan unit 1 and the lower side to which air is discharged may be referred to as an "inlet side" and an "outlet side" or merely to an "upper side" and a "lower side", respectively. However, it should be noted that the upper and lower sides in the following description are not necessarily coincident with upper and lower sides in the direction of gravity.

Figure 3:
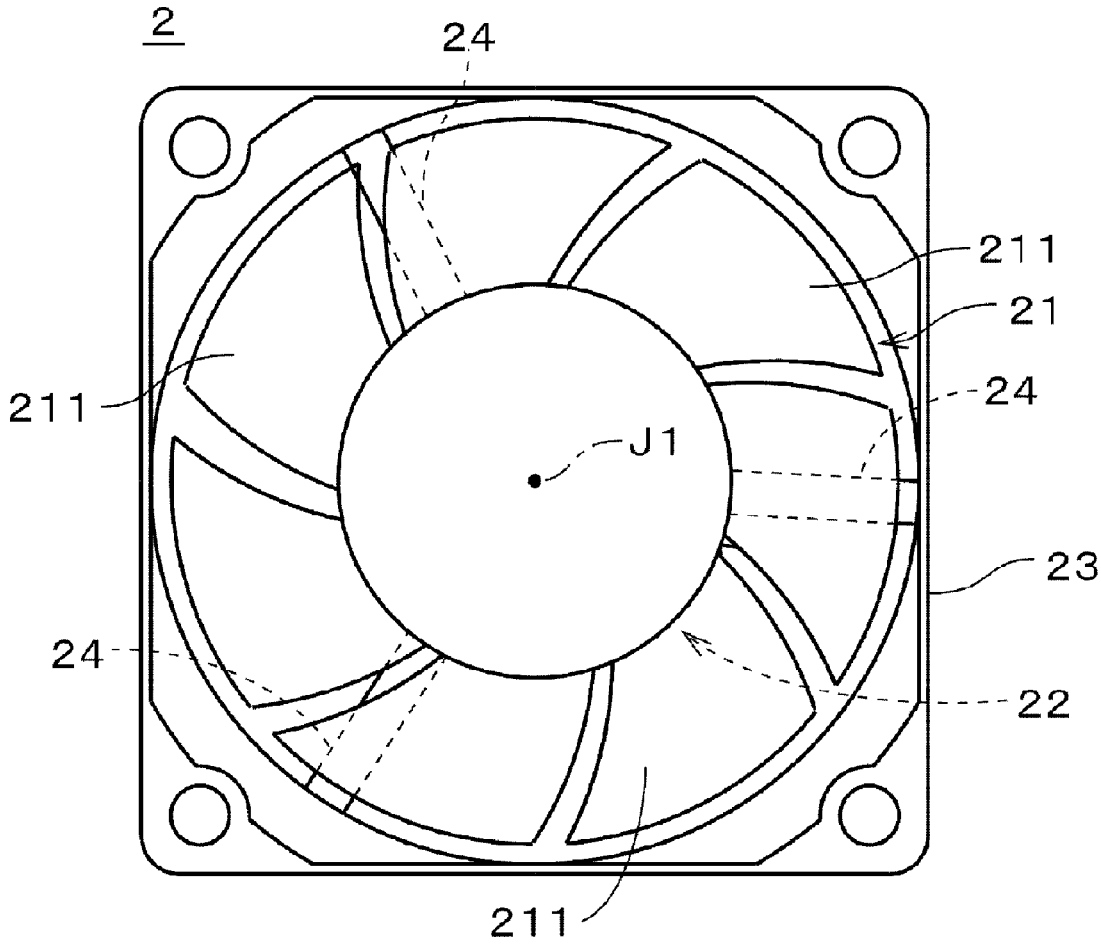
FIG. 3 is a plan view of a first axial fan of the serial axial fan unit of FIG. 1.

FIG. 3 is a plan view of the first axial fan 2 viewed from the inlet side of the serial axial fan unit 1. Referring to FIGS. 2 and 3, the first axial fan 2 preferably includes a first motor 22 having a base portion 2211 (see FIG. 2) arranged adjacent to the second axial fan 3; a first impeller 21 which can be rotated by the first motor 22 about the center axis J1 to create an axial air flow; a first housing 23 surrounding the first impeller 21; and a plurality of first supporting ribs 24 connecting the first housing 23 and the first motor 22 to each other. In this preferred embodiment, three first supporting ribs 24 are preferably provided, for example. The first impeller 21, the first motor 22, and the first supporting ribs 24 are arranged inside the first housing 23.

In FIG. 2, the general shape of first blades 211 and that of the first supporting ribs 24 are shown on right and left sides of the center axis J1 for the sake of convenience. In addition, the first motor 22 is exaggerated in shape and/or size in FIG. 2 while diagonal lines representing a cross section of each component of the first motor 22 are omitted. The second axial fan 3 of this preferred embodiment and first and second axial fans of other preferred embodiments that will be described later are illustrated in the same manner.

Referring to FIG. 2, the first impeller 21 includes a generally cylindrical hub 212 having a cover and surrounding an outer side of the first motor 22, and a plurality of first blades 211 arranged radially about the center axis J1 at regular intervals. The blades 211 extend from an outer side surface of the hub 212 outward in a radial direction perpendicular to or substantially perpendicular to the center axis J1. In this preferred embodiment, seven blades 211 preferably are provided and are turned about in a clockwise direction in FIG. 3 by rotation of the first motor 22. The hub 212 and the blades 211 are made of resin, for example. In this case, the blades 211 and the hub 212 are formed integrally with each other as a single continuous member by injection molding.

The first motor 22 includes a first rotor 222 as a rotating assembly and a first stationary portion 221 as a stationary assembly. The first rotor 222 covers the first stationary portion 221 from axially above.

The first rotor 222 includes a generally cylindrical yoke 2221 centered on the center axis J1, a generally cylindrical field magnet 2222 secured to an inner side surface of the yoke 2221, and a shaft 2223 secured to a central portion of the yoke 2221 and extending downward. The yoke 2221 has a cover and is made of magnetic metal in this preferred embodiment. The yoke 2221 is covered by the hub 212 of the first impeller 21, so that the first rotor 222 and the first impeller 21 are joined to each other into one unit.

The first stationary portion 221 includes ball bearings 2213 and 2214 which support the first rotor 222 in a rotatable manner and a generally cylindrical bearing holder 2212. The ball bearings 2213 and 2214 are arranged in axially upper and lower portions in the bearing holder 2212. The shaft 2223 is inserted through the ball bearings 2213 and 2214, thereby being supported in a rotatable manner.

Referring to FIG. 2, the first stationary portion 221 further includes an armature 2215 which produces a torque between the armature 2215 and the field magnet 2222, and a circuit board 2216 electrically connected to the armature 2215. The armature 2215 is attached to an outer side surface of the bearing holder 2212 to radially face the field magnet 2222. The circuit board 2216, which has a control circuit for controlling the armature 2215, is attached below the armature 2215 and is electrically connected to an external power supply provided outside the serial axial fan unit 1 via a plurality of lead wires. In FIG. 2, the lead wires and the external power supply are not shown. In this preferred embodiment, the circuit board 2215 is generally annular.

The first stationary portion 221 further includes a first base portion 2211 supporting the above-described components of the first stationary portion 221. The first base portion 2211 is arranged below the first stationary portion 221 and is connected to the first housing 23 with the first supporting ribs 24 (see FIG. 3) which extend radially outward from the first base portion 2211. Thus, the first base portion 2211 relatively fixes other components of the first stationary portion 221 with respect to the first housing 23. In this preferred embodiment, the first base portion 2211, the first supporting ribs 24 and the first housing 23 are preferably made of resin and are preferably formed by injection molding into a single continuous member.

Figure 4:
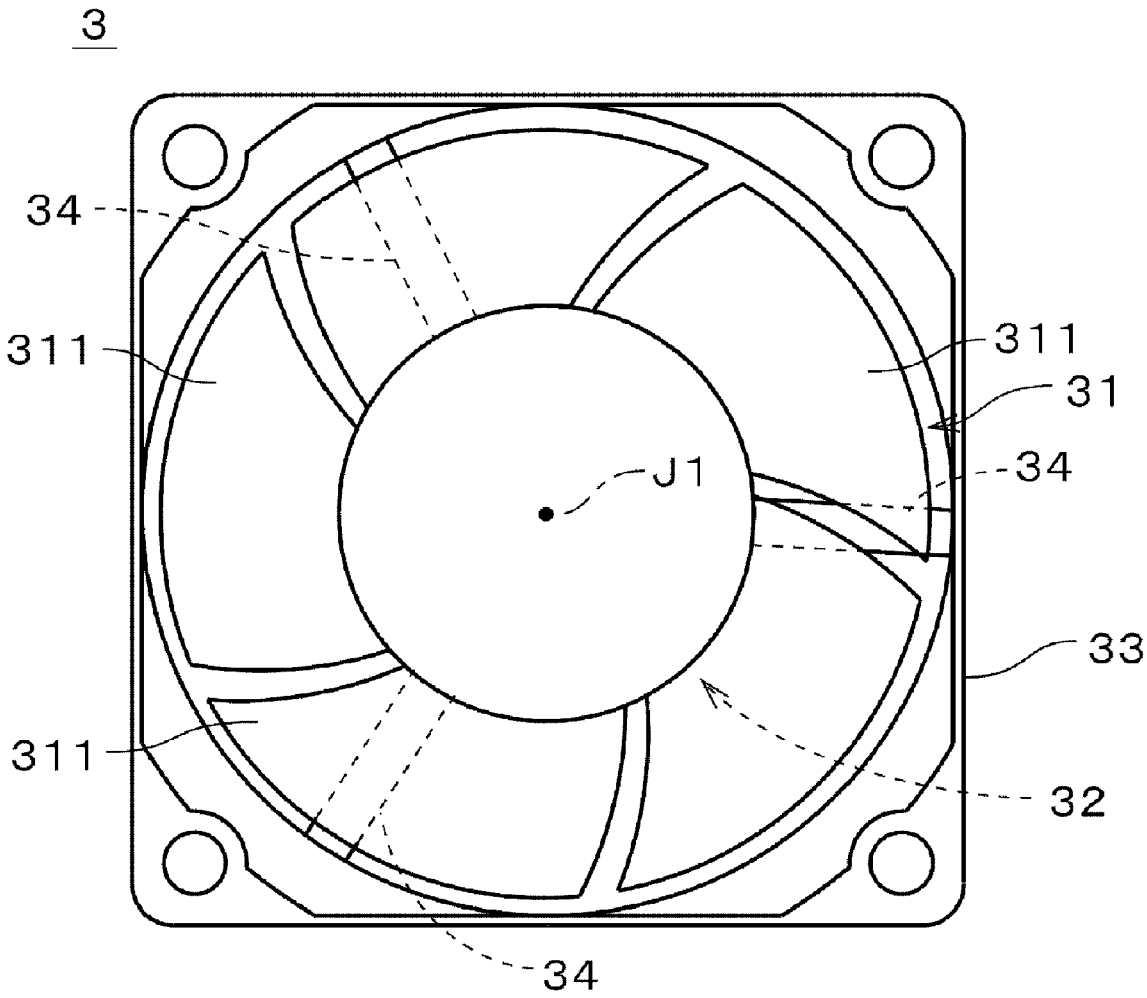
FIG. 4 is a bottom view of a second axial fan of the serial axial fan unit of FIG. 1.

FIG. 4 is a view of the second axial fan 3 as viewed from the outlet side of the serial axial fan unit 1, i.e., a bottom view of the second axial fan 3 in a positional relationship of FIG. 2. That is, the upper side in FIG. 3 corresponds to the lower side in FIG. 4. Referring to FIGS. 2 and 4, the second axial fan 3 preferably includes a second motor 32; a second impeller 31 which can be rotated about the center axis J1 by the second motor 32 to create an axial air flow flowing in the same direction as the axial air flow created by the first impeller 21; a second housing 33 surrounding the second impeller 31; and a plurality of second supporting ribs 34 connecting the second housing 33 and the second motor 32 to each other. In this preferred embodiment, three second supporting ribs 34 are preferably provided, for example.

The second housing 33 surrounds the second impeller 31 and second motor 32. An upper end surface of the second housing 33 in FIG. 2 is in contact with a lower end surface of the first housing 23 over its entire periphery. That is, a small space between the first axial fan 2 and the second axial fan 3 are tightly closed.

The second motor 32 has the same structure as the first motor 22 except that the structure of the first motor 22 is turned upside down. Referring to FIG. 2, in the second motor 32, a second stationary portion 321 is located above a second rotor 322. The second stationary portion 321 has a second base portion 3211 axially facing the first base portion 2211 of the first axial fan 2 with a gap 41 arranged therebetween. Hereinafter, this gap 41 is referred to as a motor gap 41. In this preferred embodiment, an axial length of the motor gap 41 is preferably designed to be in a range from approximately 0.3 mm to approximately 2.0 mm.

When the axial length of the motor gap 41 is preferably designed to be about 0.3 mm or more, it is possible to surely arrange the first and second base portions 2211 and 3211 away from each other without being affected by thermal deformation thereof and variation in the molding precision in a case of using typical resin material for fans, e.g., PBT or ABS. Moreover, in a case of a large axial fan (e.g., a 120-mm square fan), it is preferable to design the axial length of the motor gap 41 to be approximately 2.0 mm considering manufacturing errors. Furthermore, when the axial length of the motor gap 41 is designed to about 2.0 mm or less, it is possible to prevent unnecessary increase in the axial length (height) of the serial axial fan unit 1.

The second stationary portion 321 of the second motor 32 has the same structure as the first motor 22. More specifically, the second stationary portion 321 includes a generally cylindrical bearing holder 3212 and ball bearings 3213 and 3214 held in axially upper and lower portions of the bearing holder 3212. The stationary portion 321 also includes an armature 3215 attached to an outer side of the bearing holder 3212 and a circuit board 3216 attached above the armature 3215. The circuit board 3216 is electrically connected to an external power supply (not shown) via a plurality of lead wires (not shown).

The second rotor 322 preferably has the same structure as the first rotor 222 of the first motor 22. That is, the second rotor 322 includes a generally cup-shaped yoke 3221 centered on the center axis J1, a generally cylindrical field magnet 3222 secured to an inner side surface of the yoke 3221, and a shaft 3223 secured to a central portion of the yoke 3221 and extending upward. The field magnet 3222 produces a torque between the armature 3215 and the field magnet 3222.

A second impeller 31 has a second hub 312 covering an outer side of the yoke 3221 and a plurality of second blades 311 (see FIG. 4) radially arranged about the center axis J1 at regular intervals. The second blades 311 extend from an outer side surface of the second hub 312 radially in the radial direction. In this preferred embodiment, the second hub 312 and the second blades 311 preferably are made of resin and formed into a single continuous member by molding. Preferably, five of the second blades 311 are provided in this preferred embodiment, for example. That is, the number of the second blades 311 is different from that of the first blades 211. The second impeller 31 is rotated by the second motor 32 about the center axis J1 in a clockwise direction in FIG. 4, i.e., in an opposite direction to the rotation direction of the first impeller 21 by the second motor 32, thereby discharging air delivered from above by the first axial fan 2, downward.

As shown in FIGS. 2 and 4, the second supporting ribs 34 extend from the second base portion 3211 of the second motor 32 radially outward and are connected at their radially outer ends to the second housing 33. Thus, the second stationary portion 321 is fixed relative to the second housing 33. Moreover, as shown in FIGS. 3 and 4, the second supporting ribs 34 and the first supporting ribs 24 are preferably the same in number, and each second supporting rib 33 axially faces a corresponding first supporting rib 24 while being spaced from that first supporting rib 24. In other words, the first supporting ribs 24 are not in contact with the second supporting ribs 34 but substantially cover the second supporting ribs 34 when the serial axial fan unit 1 is seen from the inlet side along the axial direction parallel to the center axis J1. Please note that the second base portion 3211, the second supporting ribs 34 and the second housing 33 preferably are formed by injection molding of resin into a single continuous member like the similar components of the first axial fan 2 in this preferred embodiment.

In the serial axial fan unit 1 of this preferred embodiment, the motor gap 41 is provided between the first and second motors 22 and 32. Due to the motor gap 41, interference between vibration of the first motor 22 and that of the second motor 32 can be reduced. In other words, a level of a harsh noise (that may be referred to as "modulation") caused by vibration interference between the first and second motors 22 and 32 can be lowered. Moreover, since there is a gap between the first supporting ribs 24 and the second supporting ribs 34 in the serial axial fan unit 1, vibration interference between the first and second axial fans 2 and 3 caused by vibrations of the first and second motors 22 and 23 can be further reduced.

Especially in a case where a rotation speed of the impellers 21 and 31 is increased in order to improve static pressure characteristics, vibrations of the first and second axial fans 2 and 3 themselves (the first and second motors 22 and 32) become larger because of effects of unbalanced rotation (eccentricity of rotation) of the impellers with respect to rotation axes, thus making the magnitude of the vibration interference between the two axial fans non-negligible. The structure of the serial axial fan unit 1 shown in FIG. 2 is suitable for a fan unit which has that problem.

Figure 5A:
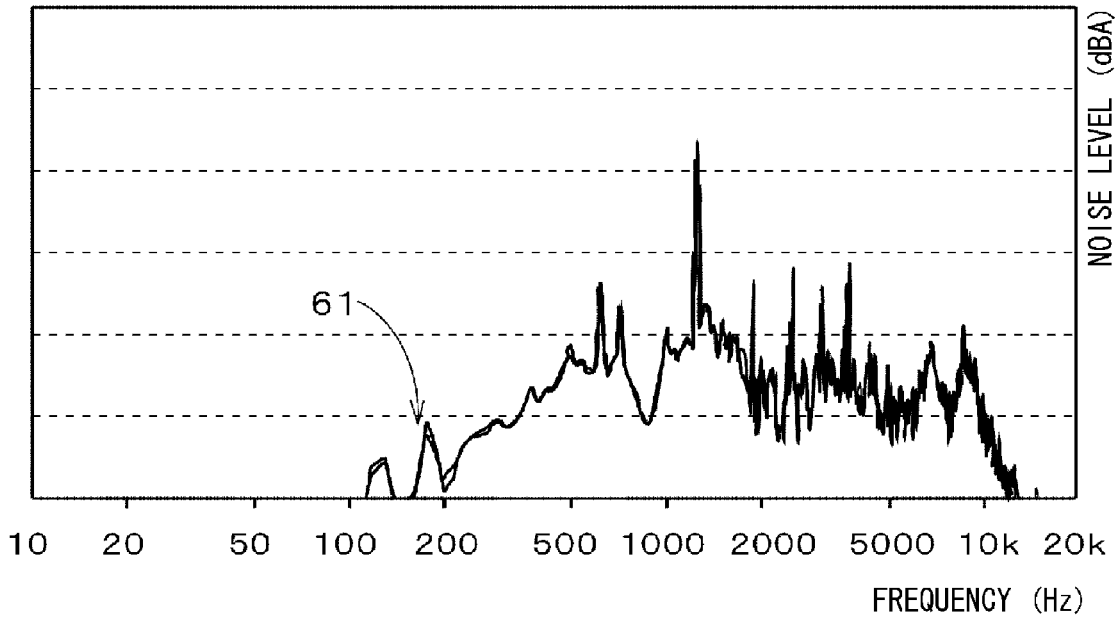
FIG. 5A shows exemplary vibration characteristics of the serial axial fan unit according to the first preferred embodiment of the present invention.
Figure 5B:
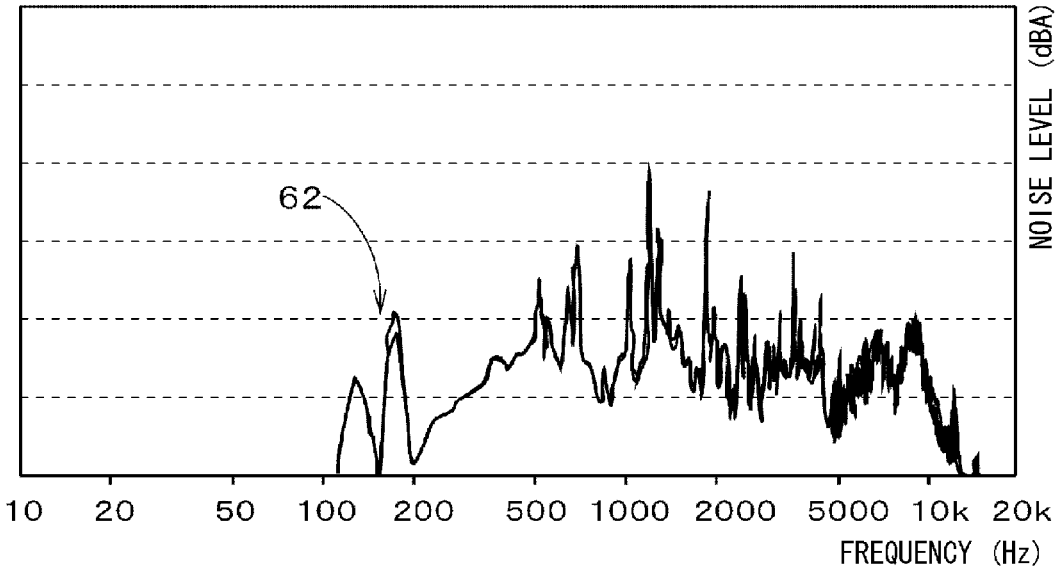
FIG. 5B shows vibration characteristics of a comparative serial axial fan unit.

FIG. 5A shows exemplary vibration characteristics of the serial axial fan unit 1. FIG. 5B shows vibration characteristics of a comparative serial axial fan unit in which two motors are in contact with each other. In each of FIGS. 5A and 5B, vibration characteristics of two axial fans are superimposed. As apparent from portions 61 and 62 in FIGS. 5A and 5B, a noise level in a low frequency range constituting to vibration interference, until 200 Hz can be lowered by arranging two motors apart from each other.

In the serial axial fan unit 1, the first supporting ribs 24 and the second supporting ribs 34 axially face each other. Thus, the number of interferences of an air flow created in the serial axial fan unit 1 with the ribs 24 and 34 is limited to one. If the first supporting ribs 24 and the second supporting ribs 34 do not axially face each other, for example, the first supporting ribs 24 and the second supporting ribs 34 are spaced away from each other by a distance equal to an axial height of the first axial fan 2 or the second axial fan 3. In this case, the air flow interferes with the supporting ribs 24 and 34 twice, i.e., interferes with the first supporting ribs 24 once and then with the second supporting ribs 34 once. Thus, the supporting ribs 24 and 34 serve as obstacles for the air flow, reducing the flow rate. To the contrary, the serial axial fan unit 1 can minimize obstacles for the air flow and can therefore prevent reduction in the flow rate.

Figure 6:
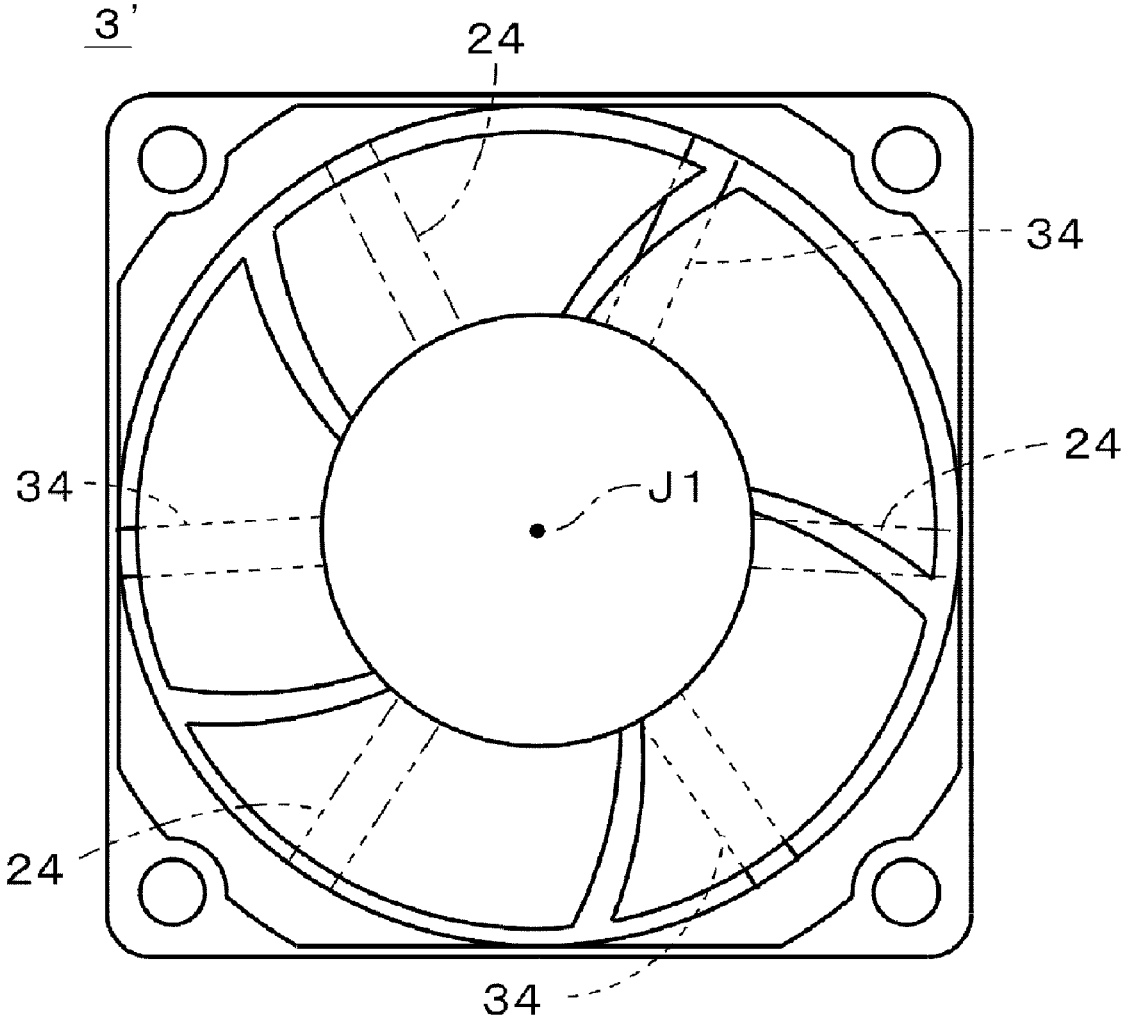
FIG. 6 is a bottom view of another exemplary second axial fan of the serial axial fan unit according to the first preferred embodiment of the present invention.

Next, a variant of the serial axial fan unit 1' of the first preferred embodiment is described. This serial axial fan unit 1' has the same structure shown in FIGS. 2 and 3 except that the second axial fan 3 is replaced with a second axial fan 3' shown in FIG. 6. FIG. 6 is a bottom view of the second axial fan 3' when viewed from the outlet side of the serial axial fan unit 1'. The lower side in FIG. 6 corresponds to the upper side in FIG. 3. In FIG. 6, the dashed line represents the positions of the second supporting ribs 34 while the chain double-dashed line represents the positions of three first supporting ribs 24 shown in FIG. 3.

The second axial fan 3' of FIG. 6 is the same as the second axial fan 3 of FIG. 4 except for the arrangement of the second supporting ribs 34. As shown in FIG. 6, the first supporting ribs 24 are arranged circumferentially between the second supporting ribs 34. In other words, when the serial axial fan unit 1' is seen from the inlet side in the axial direction, the first supporting ribs 24 do not cover the second supporting ribs 34.

In a case of using the second axial fan 3' of FIG. 6, a total occupied area of the supporting ribs 24 and 34 is larger than that in the second axial fan 3 of FIG. 4 when seen in the axial direction and therefore the flow rate of the serial axial fan unit 1' is slightly reduced. However, the use of the second axial fan 3' of FIG. 6 provides an advantage that frequency characteristics of a noise generated by an air flowing from the first axial fan 2 to the second axial fan 3' can be changed by appropriately adjusting an interval between the first supporting rib 24 and the second supporting rib 34. That is, the frequency of the noise caused by the air flowing from the first axial fan 2 to the second axial fan 3' can be changed. Therefore, it is possible to reduce an undesirable frequency component of the noise of the serial axial fan unit 1'.

Second Preferred Embodiment

Figure 7:
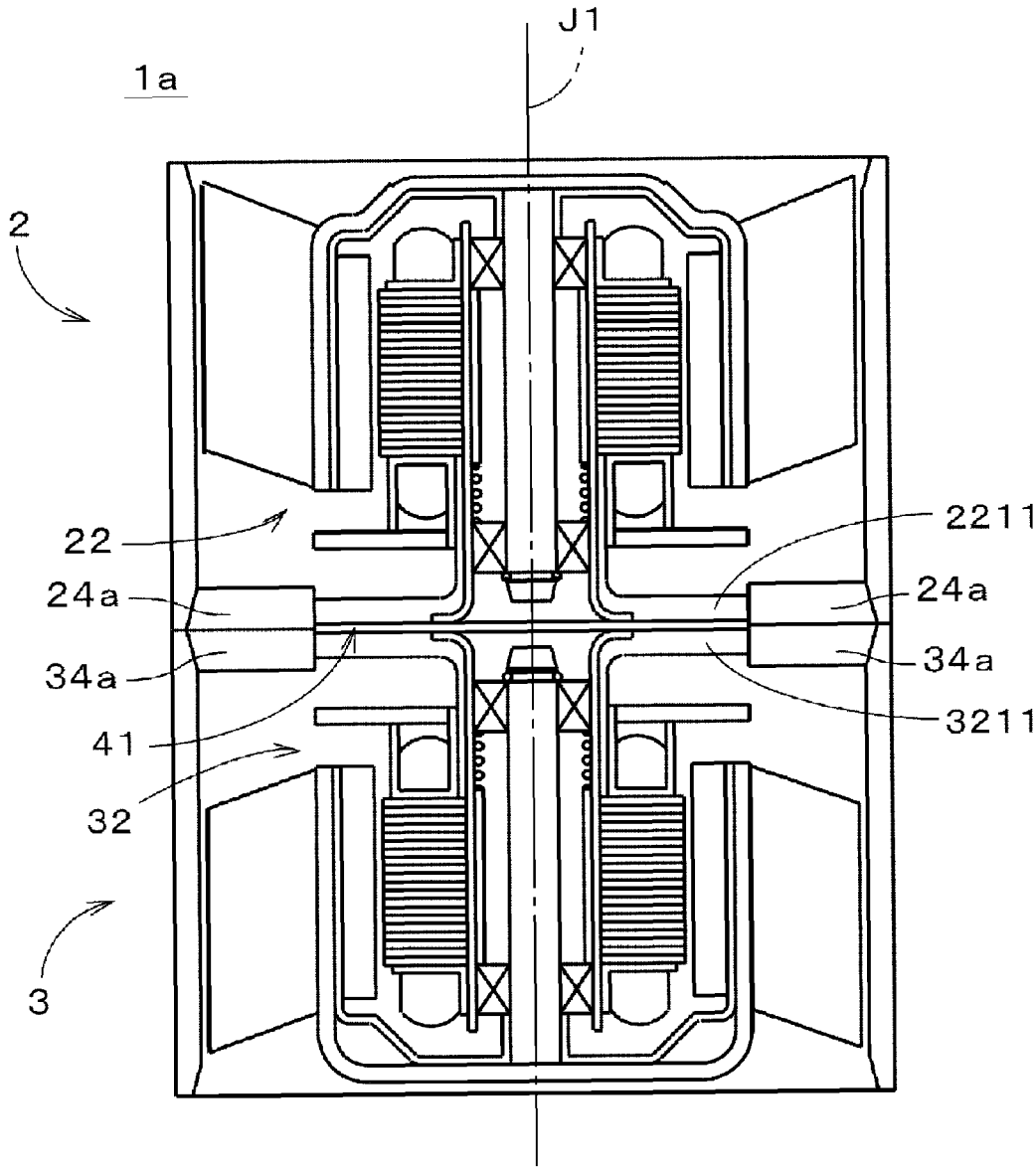
FIG. 7 is a vertical cross-sectional view of a serial axial fan unit according to a second preferred embodiment of the present invention.

FIG. 7 is a vertical cross-sectional view of a serial axial fan unit 1*a* according to a second preferred embodiment of the present invention. The serial axial fan unit 1*a* includes the first and second axial fans 2 and 3 which are oppositely oriented relative to each other and connected in series along the center axis J1, as in the first preferred embodiment. The first and second axial fans 2 and 3 are coaxially arranged with each other. As in the first preferred embodiment, there is a motor gap 41 provided between the first base portion 2211 of the first motor 22 and the second base portion 3211 of the second motor 32. The number of the first supporting ribs 24*a* of the first axial fan 2 is equal to the number of the second supporting ribs 34*a* of the second axial fan 3. The first supporting ribs 24*a* axially face the second supporting ribs 34*a* while being in contact with each other, as shown in FIG. 7. That is, the serial axial fan unit 1*a* of FIG. 7 is different from that of FIG. 2 in that the first supporting ribs are in contact with the second supporting ribs.

Since the motor gap 41 is provided between the first and second motors 22 and 32 in the serial axial fan unit 1*a* as in the first preferred embodiment, vibration interference between the motors 22 and 32 can be reduced. Moreover, since the first supporting ribs 24*a* are in contact with the second supporting ribs 34*a*, vibrations of the first and second motors 22 and 32 can be reduced even if the rigidity of each supporting rib is not high. Also, disturbances of an air flow by the first and second supporting ribs 24*a* and 34*a* can be reduced. It is preferable in this preferred embodiment to design the axial length of the motor gap 41 to be in a range from approximately 0.3 mm to approximately 2.0 mm as in the first preferred embodiment.

Third Preferred Embodiment

Figure 8:
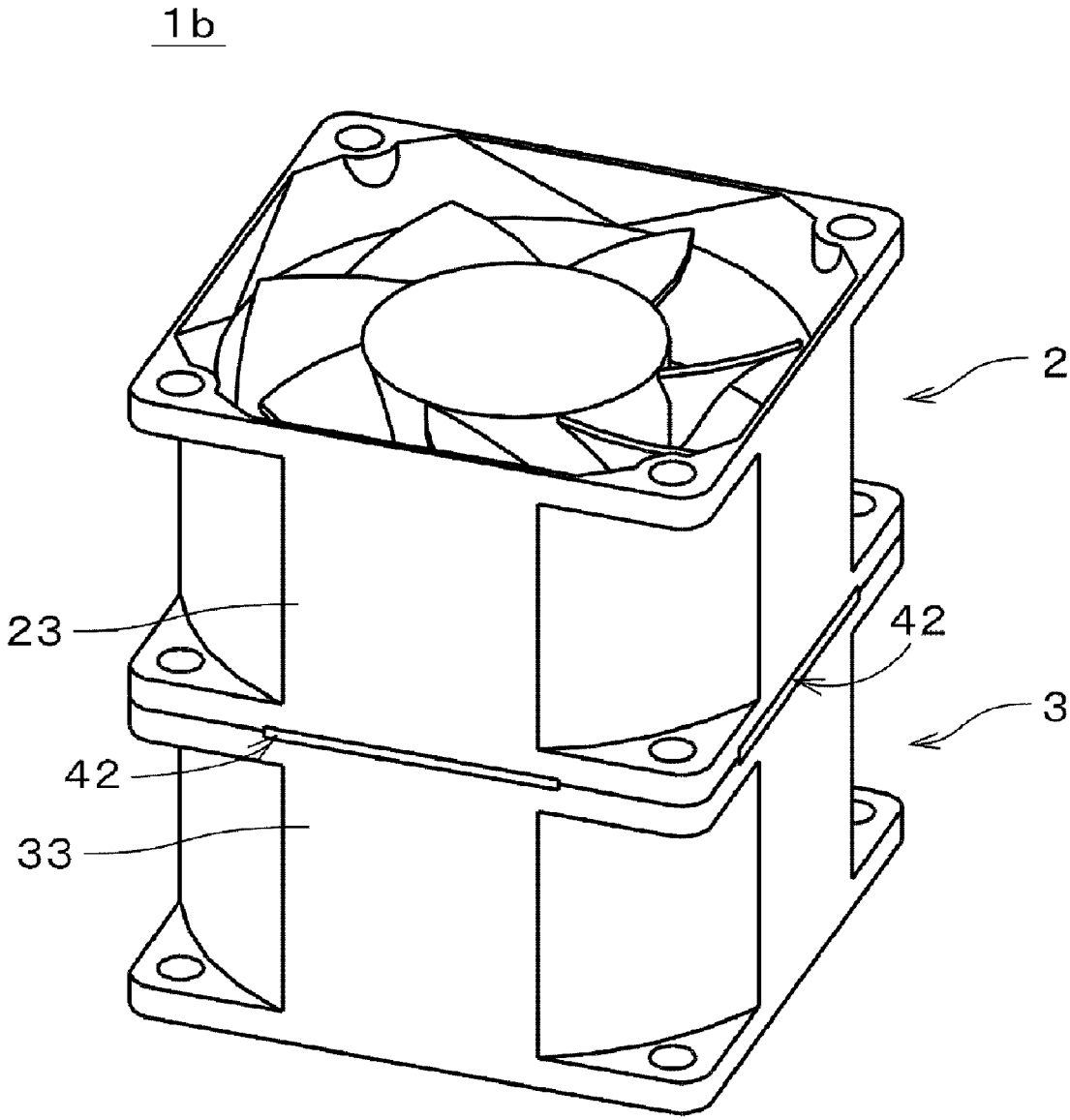
FIG. 8 is a perspective view of a serial axial fan unit according to a third preferred embodiment of the present invention.

FIG. 8 is a perspective view of a serial axial fan unit 1*b* according to a third preferred embodiment of the present invention. The serial axial fan unit 1*b* is different from that of the first preferred embodiment in that a slit-like gap 42 is provided between the first housing 23 of the first axial fan 2 and the second housing 33 of the second axial fan 3. Hereinafter, the slit-like gap 42 is referred to as a "housing gap". Except for the above, the serial axial fan unit 1*b* is the same as the serial axial fan unit 1 of the first preferred embodiment. Therefore, the detailed description of the same portion of the structure is omitted.

An outer shape of the serial axial fan unit 1*b* preferably is a generally rectangular solid shape, as shown in FIG. 8. The housing gap 42 is provided around a center of each of four side surfaces of the serial axial fan unit 1*b*. Due to the housing gap 42, the inside and the outside of a housing assembly which is formed by the first and second housings 23 and 33 can communicate with each other perpendicularly to the center axis J1. In this configuration, the upper end surface of the second housing 33 is in partial contact with the lower end surface of the first housing 23.

The inner structure of the serial axial fan unit 1*b* is the same as that in the first preferred embodiment. Alternatively, the inner structure of the serial axial fan unit 1*b* may be the same as that in the second preferred embodiment or the fourth preferred embodiment described later. In a case where the inner structure of the serial axial fan unit 1*b* is the same as that in the second preferred embodiment and each first supporting rib 24*a* and the second supporting rib 34*a* corresponding thereto extend toward the housing gap 42, the first supporting rib 24*a* and the second supporting rib 34*a* axially moves away from each other near the housing gap 42 so as to be connected to the first housing 23 and the second housing 33, respectively. Moreover, if all the supporting ribs are connected to the housing assembly in regions where the housing gaps 42 are arranged, the housing gaps 42 are partially closed by the supporting ribs. This configuration can minimize an air leak from the housing gaps 42. Furthermore, when the supporting ribs are connected to the housing assembly in the regions where the housing gaps 42 are formed, vibration can be absorbed by portions surrounding the housing gaps 42. Thus, vibration transmission from the supporting ribs to the housing assembly can be reduced.

Due to the housing gaps 42, transmission of vibrations of the first and second motors 22 and 32 to the first and second housings 23 and 33 and interference between the transmitted vibrations can be reduced. Consequently, vibration interference between the first axial fan 2 and the second axial fan 3 can be further reduced. From a viewpoint of reduction in transmitted vibrations, it is desirable to form each housing gap 42 in a central region around the boundary between the first and second housing 23 and 33 so as to extend over a half length in a direction that is perpendicular or substantially perpendicular to the center axis J1 on each side surface of the serial axial fan 1*b*. In addition, it is preferable that an axial length of the housing gap 42 be designed to be in a range from approximately 0.1 mm to approximately 0.5 mm. Please note that actual lower limit of the axial length of the housing gap 42 is not necessarily precisely 0.1 mm as long as the designed axial length is 0.1 mm. The same can be said for the upper limit. With the housing gaps 42 each having the axial length of this range, it is possible to prevent leak of air which flows in the serial axial fan unit 1*b* through the housing gaps 42 and to reduce vibration interference.

Figure 9:
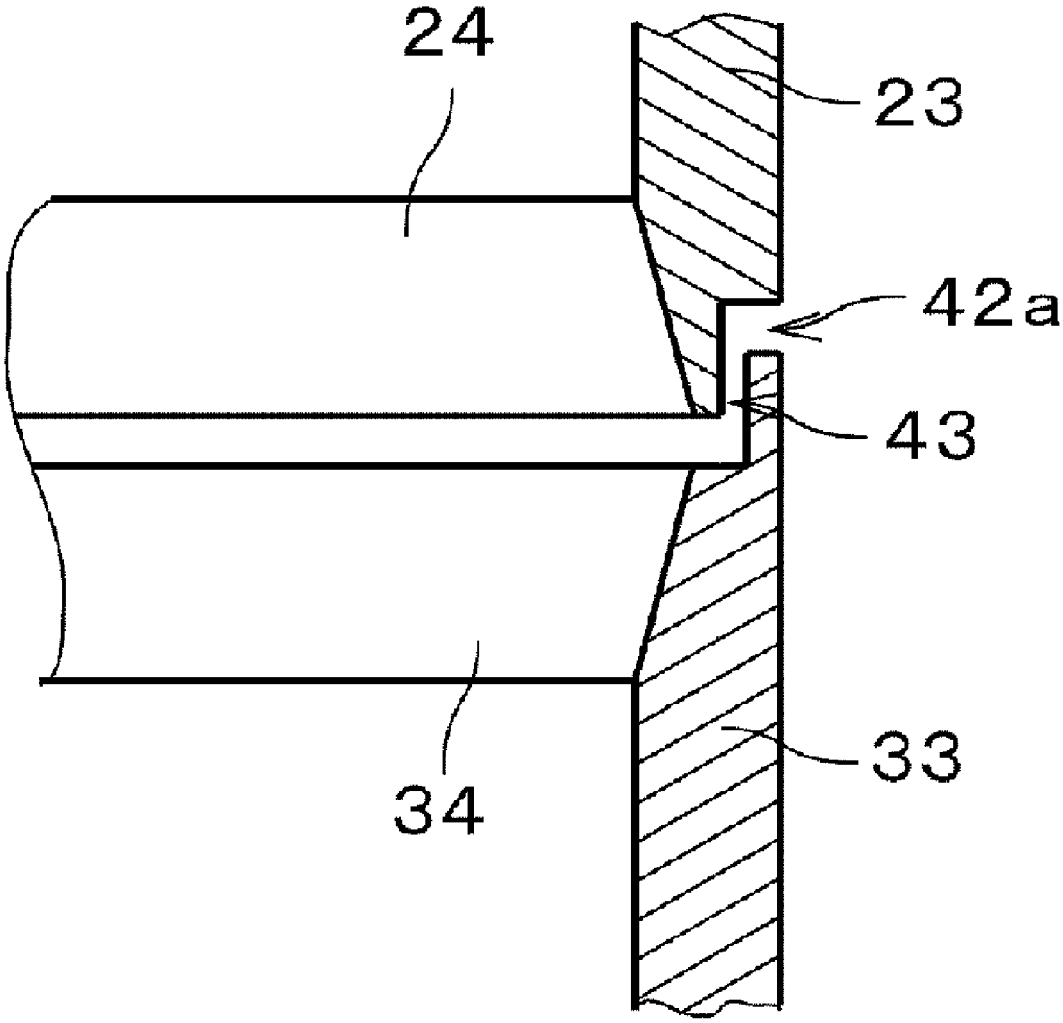
FIG. 9 is a cross-sectional view showing another exemplary structure of a housing gap in the serial axial fan unit of the third preferred embodiment of the present invention.

FIG. 9 is a vertical cross-sectional view around the boundary between the first housing 23 and the second housing 33 and shows another exemplary housing gap 42*a*. FIG. 9 also shows portions of the first and second supporting ribs 24 and 34.

The housing gap 42*a* shown in FIG. 9 has a so-called labyrinth structure 43 which includes an axially extending portion between an interface with the outside of the first and second housings 23 and 33 (i.e., the outside of the housing assembly of the serial axial fan unit 1*b*) and an inner side surface of the housing assembly. More specifically, the housing gap 42 starts from the interface with the outside of the housing assembly, extends horizontally (i.e., perpendicularly to the center axis J1) toward the inner side surface of the housing assembly, is bent and extends downward along the center axis J1, is bent and extends horizontally toward the inner side surface, and finally reaches an inner space defined by the housing assembly. In the labyrinth structure 43, a gap width (an axial length of the horizontally extending portion and a horizontal length of the axially extending portion) is preferably designed to be in a range from approximately 0.1 mm to approximately 0.5 mm, for example. The labyrinth structure 43 is provided in as a large area as possible around the boundary between the first housing 23 and the second housing 33.

With the housing gap 42*a* having the labyrinth structure 43, vibration interference between the first axial fan 2 and the second axial fan 3 can be reduced while an air leak to the outside of the serial axial fan unit can be prevented. The labyrinth structure 43 may be more complicated.

Fourth Preferred Embodiment

Figure 10:
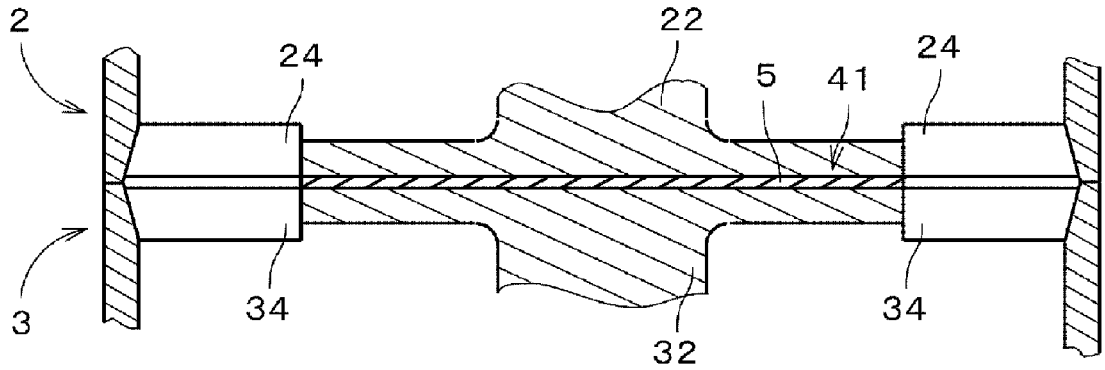
FIG. 10 is a vertical cross-sectional view of a portion of a serial axial fan unit according to a fourth preferred embodiment of the present invention.

FIG. 10 is a vertical cross-sectional view of a portion of a serial axial fan unit according to a fourth preferred embodiment of the present invention. The serial axial fan unit of this preferred embodiment is similar to that of the first preferred embodiment. Therefore, FIG. 10 only shows a portion around the boundary between the first axial fan 2 and the second axial fan 3. The inner structure of the first and second motors 22 and 32 is omitted in FIG. 10.

The serial axial fan unit of the fourth preferred embodiment corresponds to the serial axial fan unit 1 of the first preferred embodiment with a buffer member 5 arranged in the motor gap 41. The buffer member 5, which may be called as an anti-vibration member or a cushion member, can absorb vibration or is highly elastic. With this configuration, vibrations of the first motor 22 and the second motor 32 can be reduced and therefore vibration interference between them can be further reduced.

Although the buffer member 5 is added to the serial axial fan unit 1 of the first preferred embodiment, the buffer member 5 can be added to the serial axial fan units 1*a* and 1*b* of the second and third preferred embodiments.

Here, a case is considered where a name plate on which a model name, a rated specification, a lot number, and the like are printed is bonded to each of two base portions of axial fans constituting a serial axial fan unit and those axial fans are assembled with each other with the two name plates in contact with each other. In this case, resonance of vibrations generated by the two axial fans can be reduced. However, modulation caused by the resonance cannot be sufficiently reduced. This is because name plates are usually formed by adhesive-backed paper made of bond paper, synthetic paper made of synthetic resin, or PET (polyethylene terephthalate). That is, the name plates cannot have a satisfactory level of buffering effect.

On the other hand, when a name plate for indicating the model name and the like is formed by stacking a plurality of sheet-like or plate-like members one or more of which are made of elastic material such as rubber or vibration-absorbing material such as cushion material, the name plate can have a satisfactory level of buffering effect. In the serial axial fan unit of the fourth preferred embodiment, the name plate formed as a stack of a plurality of members may be used as the buffer member 5.

The first through fourth preferred embodiments of the present invention are described above. However, the present invention is not limited to the above.

In the above-described preferred embodiments, the first motor 22 and the second motor 32 are preferably spaced completely away from each other with the motor gap 41 therebetween. However, it is not necessary that the first and second motors 22 and 32 are spaced completely away from with each other as long as the motor gap 41 is arranged substantially between the first and second motors 22 and 32.

Figure 11:
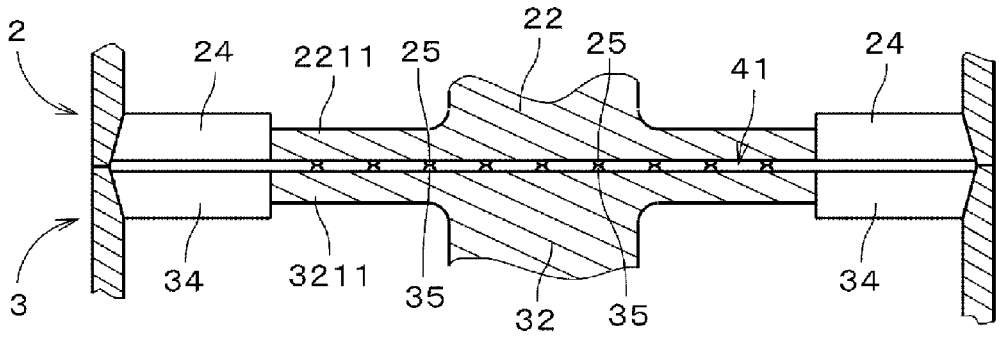
FIG. 11 is a vertical cross-sectional view of a portion of another exemplary serial axial fan unit according to the fourth preferred embodiment of the present invention.

For example, as shown in FIG. 11, the first base portion 2211 of the first motor 22 and the second base portion 3211 of the second motor 32 of the serial axial fan unit 1 of the first preferred embodiment may have a plurality of point-like projections 25 and 35 formed on their opposing surfaces, respectively. The projections 25 and the projections 35 are in point contact with each other, so that the motor gap 41 is formed. This structure can largely reduce an area of contact between the first motor 22 and the second motor 32, thus reducing vibration transmission. Therefore, vibration interference between the first and second motors 22 and 32 can be reduced.

In the example of FIG. 11, the projections 25 and 35 can be regarded as having substantially the same function as the buffer member 5 shown in FIG. 10. In addition, the projections 25 and 35 may be linear along the corresponding surface of the base portion. Furthermore, the aforementioned small contact using the projections or the buffer member may be provided in a gap between the first supporting ribs 24 and the second supporting ribs 34.

In the above preferred embodiments, the housing gap 42 is designed to be approximately 0.1 mm or more. This is because, if the housing gap 42 is designed to be less than about 0.1 mm, the dimension of the housing gap 42 may not be ensured because of variation in mold dimensions when molding precision is not good. Therefore, if a sophisticated molding technique giving small errors is used, the dimension of the housing gap 42 can be designed to be less than about 0.1 mm. Similarly, the motor gap 41 may be designed to be less than about 0.3 mm if a sophisticated molding technique is used.

The first supporting ribs 24, 24*a* and the second supporting ribs 34, 34*a* do not necessarily extend from the first base portion 2211 and the second base portion 3211 outward in the radial direction linearly, respectively. For example, the first and second supporting ribs may extend while being curved. Also, the first and second supporting ribs may be substantially parallel to or at an angle to the center axis J1. Furthermore, the number of the first supporting ribs and the number of the second supporting ribs may be different from each other.

In the third preferred embodiment, a buffer member which cannot allow air to pass therethrough may be provided in the housing gap 42. In this case, degradation of the static pressure vs. flow rate curve can be prevented, while vibration interference is reduced. In addition, the outer shapes of the first housing 23 and the second housing 33 are not limited to a rectangular solid. For example, the outer shapes of them may be substantially columnar.

In the serial axial fan units of the first through fourth preferred embodiments, the first impeller 21 of the first axial fan 2 and the second impeller 31 of the second axial fan 3 may rotate in the same direction as each other. Moreover, one or more axial fans may be added to the first and second axial fans 2 and 3 to be coaxial therewith.

As described above, according to the preferred embodiments of the present invention, vibration interferences of axial fans provided in a serial axial fan unit can be reduced without degrading a static pressure vs. flow rate curve of the serial axial fan unit.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A serial axial fan unit comprising:

a first axial fan and a second axial fan connected to and arranged coaxially with a center axis of the serial axial fan unit, wherein each of the first axial fan and the second axial fan includes:

a motor including a base portion arranged adjacent to the other axial fan;

an impeller including a plurality of blades which are radially arranged about the center axis and extend outward in a radial direction substantially perpendicular to the center axis, the impeller being rotatable about the center axis to create an axial air flow;

a housing surrounding the impeller; and supporting ribs extending from the base portion of the motor outward in the radial direction and connecting the base portion to the housing; wherein the first axial fan and the second axial fan are arranged with their base portions adjacent to and facing each other with a motor gap therebetween in an axial direction substantially parallel to the center axis; and a lower end surface of the housings of the first axial fan is arranged to only be in contact with an upper end surface of the housing of the second axial fan through substantially an entire periphery of the lower end surface of the housing of the first axial fan and substantially an entire periphery of the upper end surface of the housing of the second axial fan.

2. The serial axial fan unit according to claim 1, wherein the number of the supporting ribs is the same for the first and second axial fans, and the supporting ribs of the first fan axially face the supporting ribs of the second fan while being spaced therefrom.

3. The serial axial fan unit according to claim 2, wherein the impellers of the first axial fan and the second axial fan rotate in opposite directions to each other.

4. The serial axial fan unit according to claim 2, wherein the base portion, the supporting ribs and the housing of at least one of the first axial fan and the second axial fan is defined by a single continuous member of injection-molded resin.

5. The serial axial fan unit according to claim 2, wherein the motor gap has an axial length in a range from approximately 0.3 mm to approximately 2.0 mm.

6. The serial axial fan unit according to claim 1, wherein the number of the supporting ribs is the same for the first and second axial fans, and the supporting ribs of the first fan are in contact with the supporting ribs of the second fan.

7. The serial axial fan unit according to claim 1, wherein the supporting ribs of the first axial fan are arranged between the supporting ribs of the second axial fan when viewed from above in the axial direction.

8. The serial axial fan unit according to claim 5, wherein the housing gap includes both an axially extending gap and a radially extending gap.

9. The serial axial fan unit according to claim 1, further comprising a buffer member arranged in the motor gap.

10. The serial axial fan unit according to claim 1, wherein the impellers of the first axial fan and the second axial fan rotate in opposite directions relative to each other.

11. The serial axial fan unit according to claim 1, wherein the base portion, the supporting ribs and the housing of at least one of the first axial fan and the second axial fan is defined by a single continuous member of injection-molded resin.

12. The serial axial fan unit according to claim 1, wherein the motor gap has an axial length in a range from approximately 0.3 mm to approximately 2.0 mm.

13. A serial axial fan unit comprising:

a first axial fan and a second axial fan connected to and arranged coaxially with a center axis of the serial axial fan unit, wherein each of the first axial fan and the second axial fan includes:

a motor including a base portion arranged adjacent to the other axial fan;

an impeller including a plurality of blades which are radially arranged about the center axis and extend outward in a radial direction substantially perpendicular to the center axis, the impeller being rotatable about the center axis to create an axial air flow;

a housing surrounding the impeller; and supporting ribs extending from the base portion of the motor outward in the radial direction and connecting the base portion to the housing; wherein the first axial fan and the second axial fan are arranged with their base portions adjacent to and facing each other with a motor gap therebetween in an axial direction substantially parallel to the center axis, and the housings of the first axial fan and the second axial fan are in contact with each other except for a region where a housing gap is arranged axially between the housings of the first axial fan and the second axial fan, the inside and the outside of the housings being in communication with each other through the housing gap, and an axial length of the housing gap is approximately 0.5 mm or less.

14. The serial axial fan unit according to claim 13, wherein the number of the supporting ribs is the same for the first and second axial fans, and the supporting ribs of the first fan axially face the supporting ribs of the second fan while being spaced therefrom.

15. The serial axial fan unit according to claim 14, wherein the impellers of the first axial fan and the second axial fan rotate in opposite directions relative to each other.

16. The serial axial fan unit according to claim 14, wherein the base portion, the supporting ribs and the housing of at least one of the first axial fan and the second axial fan is defined by a single continuous member of injection-molded resin.

17. The serial axial fan unit according to claim 14, wherein the motor gap has an axial length in a range from approximately 0.3 mm to approximately 2.0 mm.

18. The serial axial fan unit according to claim 13, wherein the number of the supporting ribs is the same for the first and second axial fans, and the supporting ribs of the first fan are in contact with the supporting ribs of the second fan.

19. The serial axial fan unit according to claim 13, wherein the supporting ribs of the first axial fan are arranged between the supporting ribs of the second axial fan when viewed from above in the axial direction.

20. The serial axial fan unit according to claim 13, wherein the axial length of the housing gap is in a range from approximately 0.1 mm to approximately 0.5 mm, and the region where the housing gap is formed extends over at least a half length of a side surface of the housings in a direction that is substantially perpendicular to the center axis.

21. The serial axial fan unit according to claim 13, further comprising a buffer member arranged in the motor gap.

22. The serial axial fan unit according to claim 13, wherein the impellers of the first axial fan and the second axial fan rotate in opposite directions relative to each other.

23. The serial axial fan unit according to claim 13, wherein the base portion, the supporting ribs and the housing of at least one of the first axial fan and the second axial fan is defined by a single continuous member of injection-molded resin.

24. The serial axial fan unit according to claim 13, wherein the motor gap has an axial length in a range from approximately 0.3 mm to approximately 2.0 mm.

25. The serial axial fan unit according to claim 1, wherein the supporting ribs of the first axial fan are spaced away from the supporting ribs of the second axial fan.

26. The serial axial fan unit according to claim 1, wherein an axially lowermost portion of the lower end surface of the housing of the first axial fan extends axially lower than the supporting ribs of the first axial fan such that a first axial gap is defined between the supporting ribs of the first axial fan and the axially lowermost portion of the lower end surface of the housing of the first axial fan; and an axially uppermost portion of the upper end surface of the housing of the second axial fan extends axially higher than the supporting ribs of the second axial fan such that a second axial gap is defined between the supporting ribs of the second axial fan and the axially uppermost portion of the upper end surface of the housing of the second axial fan.

* * * * *